United States Patent [19]

Zverina et al.

[11] Patent Number: 4,720,083

[45] Date of Patent: Jan. 19, 1988

[54] VALVE CLOSURE GATE ASSEMBLY FOR FOUNDRY LADLES

[75] Inventors: Karel Zvěřina; Petr Kroupa; Josef Szabó, all of Prague; Věslav Maroszczyk, Třinec; Valter Böhm, Český Těšín; Antonín Cieslar, Trinec, all of Czechoslovakia

[73] Assignee: Ceskoslovenska akademie ved, Prague, Czechoslovakia

[21] Appl. No.: 601,303

[22] Filed: Apr. 17, 1984

[30] Foreign Application Priority Data

Jul. 15, 1983 [CS] Czechoslovakia ..... PV 5355-83

[51] Int. Cl.[4] ..... B22D 37/00

[52] U.S. Cl. ..... 266/275; 266/287; 222/600

[58] Field of Search ..... 266/275, 236, 280, 287, 266/271; 222/600, 603, 597, 591, 590

[56] References Cited

U.S. PATENT DOCUMENTS

| | | | |
|---|---|---|---|
| 3,685,707 | 8/1972 | Shapland | 222/600 |
| 3,743,139 | 7/1973 | Lyman | 266/236 |
| 3,801,083 | 4/1974 | Mantey et al. | 266/236 |
| 3,841,539 | 10/1974 | Shapland, Jr. et al. | 222/600 |
| 4,003,561 | 1/1977 | Cudby | 266/236 |
| 4,096,976 | 6/1978 | Daussan | 222/600 |
| 4,179,046 | 11/1979 | Jeschke et al. | 222/600 |
| 4,182,466 | 1/1980 | Fehling et al. | 222/600 |
| 4,241,905 | 12/1980 | Eisermann et al. | 266/236 |
| 4,257,542 | 3/1981 | Aller et al. | 222/600 |

FOREIGN PATENT DOCUMENTS

| | | | |
|---|---|---|---|
| 2053153 | 11/1982 | Canada . | |
| 3011878 | 10/1981 | Fed. Rep. of Germany | 222/591 |
| 1116829 | 7/1970 | France . | |

*Primary Examiner*—Melvyn J. Andrews
*Assistant Examiner*—S. Kastler
*Attorney, Agent, or Firm*—Jeffers, Hoffman & Niewyk

[57] ABSTRACT

The present invention relates to the foundry industry and solves the problem of extended service life of valve closure gate assemblies for foundry ladles. The valve closure gate assembly of the present invention comprises two mutually slidable heat-resistant gates furnished with a protecting layer of an oxide refractory material and having flow-through rings made from an oxide refractory material disposed in the openings of the gates. The respective upper and lower surfaces of the rings are coated with a layer of refractory material.

2 Claims, 4 Drawing Figures

VALVE CLOSURE GATE ASSEMBLY FOR FOUNDRY LADLES

BACKGROUND OF THE INVENTION

The present invention relates to a valve closure gate assembly for a foundry ladle comprising two mutually slidable closure gates with respective outlet openings for regulating the flow of melts.

At the present, foundry ladles with stopper rods or valve closure gates are used in steel and foundry plants. The material of which these closure elements are made should have physical and chemical properties to reliably resist high temperatures, thermal shock stresses, and the corrosive effects of molten metals and slags. The interface of contact surfaces of the gates of the valve closure gate assemblies should also prevent the leakage of melt, if the foundry ladle is closed, and their surface should be resistant to wear during multiple openings and closings.

In view of the above-mentioned requirements, application of the valve closure gates has increased recently as a consequence of their advantages in comparison to the system of stopper rods. The closure gates of valve closure gate assemblies manufactured from ceramic materials are suitable from the view of heat resistance, but the sealing surfaces of the valve closure gates become abraded and roughened during operation by the combined abrasive and corrosive action of melt and slag, thereby losing their sealing characteristics. The outlet openings are also gradually worn by the action of melt and their enlargement undesirably affects the casting process.

The above-mentioned difficulties are recently solved by manufacturing the fundamental body of the closure gate of the valve closure gate assembly from common ceramic materials, which have relatively lower melting temperatures, and by furnishing the surfaces exposed to the direct action of melt with resistant surface layers from refractory materials with suitable properties in respect to their resistance against the abrasive and corrosive action of melts. These materials are used for manufacturing the linings of flat sealing surfaces of the closure gates and serve also for lining the outlet openings, either directly or by means of connecting interlayers. The closure gates of the valve closure gate assemblies made in this way have the advantage of longer service life and greater tightness of closure in comparison to the original gates with an unprotected surface. However, their disadvantage consists in a low durability of bonds between both ceramic parts because the connection interlayer cracks due to the different heat expansions of the materials used. The difficulties occur also with surface layers applied by the technology of plasma or heat spraying, particularly in the application of this layer on the inner wall of the outlet opening.

SUMMARY OF THE INVENTION

The above-described disadvantages of the known prior art valve closure gate assemblies are overcome in the valve closure gate assembly for foundry ladles according to the present invention, which comprises two mutually slidable heat-resistant gates provided with outlet openings and a plasma-sprayed layer of an oxide refractory material on the places exposed to the direct action of melt, wherein flow-through rings made from an oxide refractory material are arranged in the openings of the heat-resistant gates, the outer surfaces of which are provided with dilatation layers. The contact surfaces of both gates are furnished with a plasma-applied surface layer of an oxide refractory material which overcoats the region of bonds between the gates and the flow-through rings. The dilatation layers on the outer surfaces of the flow-through rings may be formed by plasma spraying of a refractory ceramic material with the final porosity assuming 12 to 25 percent of the volume. The flow-through rings can be manufactured as self-supporting bodies made by plasma spraying of a refractory ceramic material having a closed porosity on the surface of the outlet opening assuming less than 10 percent of the volume and on the outer surface a porosity assuming 15 to 25 percent of the volume. The outer surface of the flow-through ring can have a conic shape with the apex pointing downwardly. The inner surface of a ceramic flow-through ring and the surface of the refractory surface-protecting layer applied by means of plasma can be saturated with carbon, and a flow-through ring or the surface protecting laver can be made from corundum, stabilized zirconium dioxide, zirconium silicate, chromic oxide, or chrommagnesite.

The preferred technique for applying the oxide refractory material is by a liquid stabilized plasma gun, for example, the type of gun disclosed in U.S. Pat. No. 4,338,509. This patent is expressly incorporated herein by reference.

The valve closure gates assemblies according to the invention provide, at relatively low cost, a long service life due to the suitable properties of materials used and the very long stability of bonds between the individual parts of the gate.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
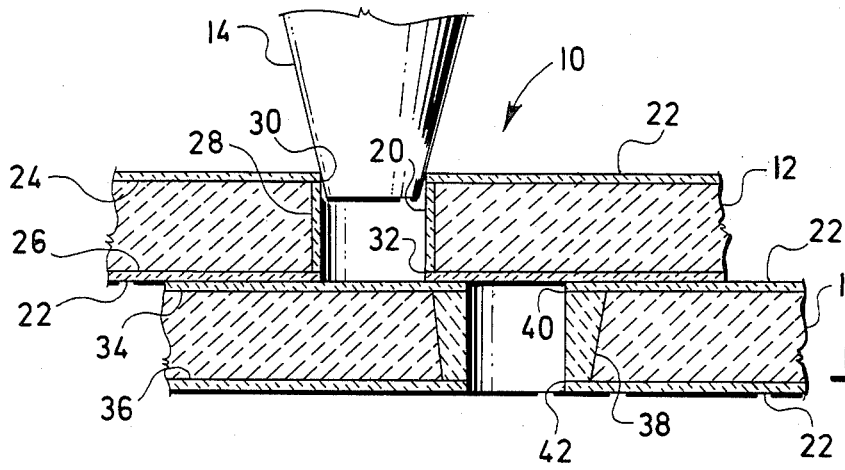
FIG. 1 is a broken-away, sectional view of a valve closure gate assembly of a preferred embodiment in the closed position.
Figure 2:
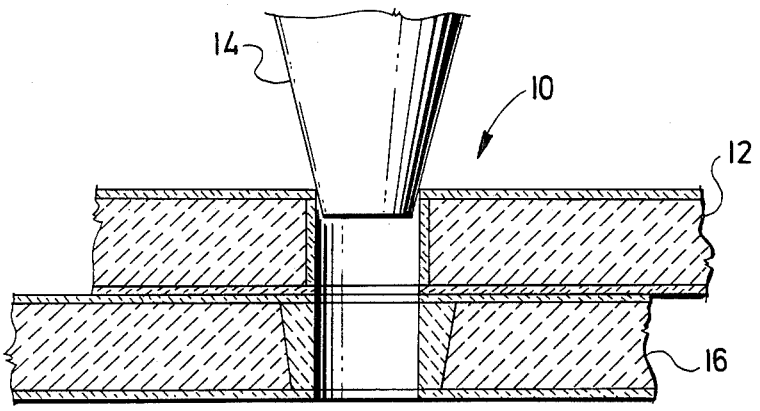
FIG. 2 is a broken-away, sectional view of the valve closure gate assembly in FIG. 1 in the opened position.
Figure 3:
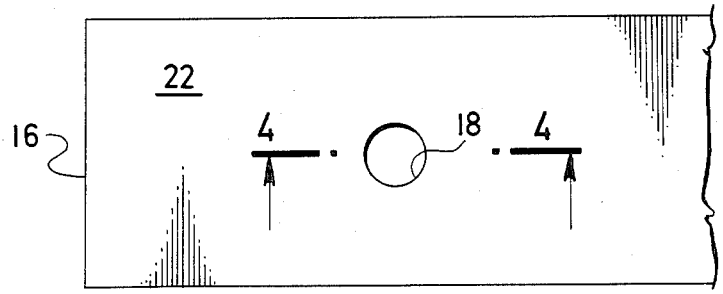
FIG. 3 is a top plan view of a closure gate of the valve closure gate assembly in FIG. 1.

Referring to the figures, the valve closure gate assembly 10 comprises stationary gate 12 fixed to the outlet opening 14 of a foundry ladle, and the movable gate 16. The stationary gate 12 and the movable gate 16 carry protecting layers on their surfaces exposed to the direct action of melt and which serve as bearing and sealing faces between them. These layers include the surface protecting layer 22 applied by plasma spraying on the upper surface 24 and the lower surface 26 of the stationary gate 12 and on the upper surface 34 and the lower surface 36 of the movable gate 16. A refractory ceramic material is disposed also in the openings of gates 12,16. Flow-through ring 20 is made from a refractory material and covers the inner surface 28 of the opening of stationary gate 12 and continuously links to, or extends between, the surface protecting layer 22 at the peripheral edges 30,32. The movable gate 16 is similarly provided with the flow-through ring 18 (FIG. 4) of refractory material covering the inner surface 38 of the opening and again continuously links to, or extends between, the surface protecting layer 22 at the peripheral edges 40,42.

Figure 4:
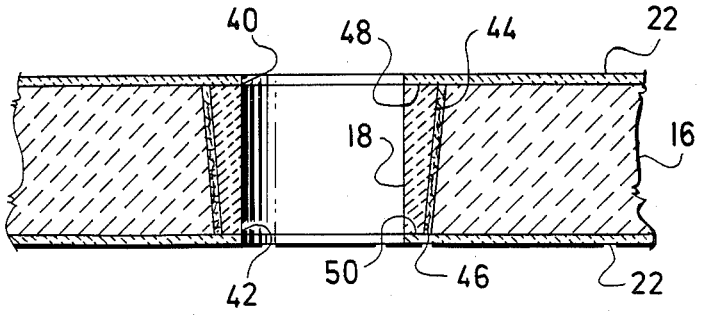
FIG. 4 is a broken-away, sectional view of a closure gate of the valve closure gate assembly in FIG. 1 in the region of an outlet opening.

Referring to FIG. 4, the sectional view of the region of the outlet opening shows in detail flow-through ring 18 of the movable gate 16. The conic outer surface 44 of the flow-through ring 18 provides secure connection between the gate 16 and the material of the flow-through ring 18, as well as the porous dilatation layer 46, which is disposed at the outer periphery of the ring 18 to eliminate undesirable effects of the different thermal expansions of the bonded materials. The upper surface 48 and the lower surface 50 of the flow-through ring 18 are also covered with the protecting layer 22.

Corundum ($Al_2O_3$), zirconium silicate ($ZrSiO_4$), zirconium dioxide ($ZrO_2$) stabilized, e.g., with 5% of calcium oxide (CaO), chromic oxide ($Cr_2O_3$), or chrom-magnesite may be advantageously used as materials for the protecting layer 22 and for the flow-through rings 18,20. All these materials have excellent physical and chemical properties suitable in casting of ferrous metals and also in their application by heat or plasma spraying, which is highly advantageous in the realization of the object of this invention. Moreover, to attain longer service life of the valve closure gate assembly, the surface layer can be advantageously saturated with carbon.

The invention is especially applicable in the foundry industry. The performance of the valve closure gate assemblies according to the present invention proved best in the testing of their service life where the same refractory material was used for both the surface protecting layers 22 and the flow-through rings 18,20, and where the porous dilatation layer 46 created on the outer surface of a flow-through ring had an average wall thickness from about 0.3 to 0.5 of the overall wall thickness of the ring and a porosity ranging from 12 to 25 volume percent. The creation of a porous dilatation interlayer between the gate body and the protecting surface layer of oxide refractory material by a suitable technology of spraying represents another advantageous feature.

While this invention has been described as having a preferred design, it will be understood that it is capable of further modifications. This application is therefore intended to cover any variations, uses, or adaptations, of the invention following the general principles thereof and including such departures from the present disclosure as come within known or customary practice in the art to which this invention pertains and fall within the limits of the appended claims.

What is claimed is:

1. In a valve closure gate asembly for a foundry ladle including two mutually slidable heat-resistant gates having respective openings therein and a surface-protecting layer of an oxide refractory material on portions thereof exposable to a melt, said coating being applied by plasma spraying, the improvement comprising a pair of flow-through ring members disposed in respective ones of said openings, said flow-through ring members being made of a material based on oxide refractory ceramics as a self-supporting refractory body having on its inner radial surface a porosity assuming less than 10 percent of the volume and on its outer radial surface a porosity assuming 15 to 25 percent of the volume, said surface-protecting layer covering respective upper surfaces and respective lower surfaces of said flow-through ring members, between said flow-through ring members and said openings a dilatation layer on the outer radial surface of at least one of said flow-through ring members is situated, and said dilatation layer is made of a refractory material with the porosity assuming 12 to 25 percent of the volume.

2. In a valve closure gate assembly for a foundry ladle including two mutually slidable heat-resistant gates having respective openings therein and a surface-protecting layer of an oxide refractory material on portions thereof exposable to a melt, said coating being applied by plasma spraying, the improvement comprising a pair of flow-through ring members disposed in respective ones of said openings, said flow-through ring members being made of a material based on oxide refractory ceramics, said surface-protecting layer covering respective upper surfaces and respective lower surfaces of said flow-through ring members, wherein said flow-through ring member of the bottommost one of said gates is formed as a self-supporting refractory body having on its inner radial surface a porosity assuming less than 10 percent of the volume and on its outer radial surface a porosity assuming 15 to 25 percent of the volume.

* * * * *